US006396469B1

(12) United States Patent
Miwa et al.

(10) Patent No.: US 6,396,469 B1
(45) Date of Patent: May 28, 2002

(54) METHOD OF DISPLAYING AN IMAGE ON LIQUID CRYSTAL DISPLAY AND A LIQUID CRYSTAL DISPLAY

(75) Inventors: Koichi Miwa, Yokohama; Kuniaki Sueoka, Kawasaki; Hajime Nakamura, Yokohama, all of (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/150,975

(22) Filed: Sep. 11, 1998

(30) Foreign Application Priority Data

Sep. 12, 1997 (JP) ..... 9-248818

(51) Int. Cl.[7] ..... G09G 3/36

(52) U.S. Cl. ..... 345/87; 345/63; 345/88; 345/89; 345/100; 345/103

(58) Field of Search ..... 345/87, 88, 89, 345/100, 103, 63

(56) References Cited

U.S. PATENT DOCUMENTS 5,731,796 A * 3/1998 Furuhashi et al. ..... 345/96
5,844,533 A * 12/1998 Usui et al. ..... 345/89
5,874,933 A * 2/1999 Hirai et al. ..... 345/89
5,926,238 A * 7/1999 Inoue et al. ..... 349/61
5,963,190 A * 10/1999 Tsuboyama et al. ..... 345/103
6,181,317 B1 * 1/2001 Taguchi et al. ..... 345/132

* cited by examiner

*Primary Examiner*—Richard Hjerpe
*Assistant Examiner*—Jean Lesperance
(74) *Attorney, Agent, or Firm*—Scully, Scott, Murphy & Presser; Marian Underweiser

(57) ABSTRACT

A system and method of displaying an image on a liquid crystal display equipped with a crystal panel which comprise a plurality of gate lines, a plurality of data lines, and pixel cells disposed in the shape of a matrix corresponding to the intersections of the gate lines and the data lines, the method comprising the steps of: (a) selecting the gate line for the display of an image on the liquid crystal panel in a first term during a frame period for displaying one image and moreover supplying an image signal to display the image to the data line; and (b) selecting the gate line again in a second term during the same frame period as that of the first term, the first term and the second term being in the same frame period, and supplying a non-image signal having a predetermined potential and different from the image signal to the data line during the second term, whereby supply of the non-image signal is for displaying a blanking image.

16 Claims, 3 Drawing Sheets

METHOD OF DISPLAYING AN IMAGE ON LIQUID CRYSTAL DISPLAY AND A LIQUID CRYSTAL DISPLAY

BACKGROUND OF THE INVENTION

1. Technical Field

The present invention relates to an image display method in a liquid crystal display and a liquid crystal display and in particular to a liquid crystal display using the liquid crystal mode with high-speed response.

2. Prior Art

As an art for improving the display characteristics of an image displayed on a liquid crystal panel, for example, as disclosed in Published Unexamined Patent Application No. 64-82019, there is a method for the intermittent lighting of backlights in synchronism with the frame period. That is, a plurality of selectively lightable backlights are provided and are lighted and extinguished in sequence with the timing of driving the scanning electrodes of a liquid crystal display. The respective backlights are so arranged as to be lighted right after all image scanning electrodes within individual lighting range have been selected and are extinguished after the lapse of a predetermined period. With respect to each scanning line, a backlight is lighted only during the moment while its contrast ratio is high or otherwise extinguished. It is referred to as blanking that in order to allow an image display only for a desired term in such a manner, a non-image is forcibly displayed during the other terms (including a non-display condition made by extinguishing the backlights). Because of preventing different frames continuous to each other from becoming visible by mixing in one screen during a given time, this blanking can improve the image quality of a display image, especially the display characteristics of a dynamic image.

The background art mentioned above has a problem that the optimal timing for each scanning line cannot be set because the blanking can be performed only in the unit of a backlight. That is, individual scanning lines are successively driven at a slight shift of timing. Accordingly, with different scanning lines, the moment of peak contrast also differs. For a small number of backlights (i.e., when the lighting range of one backlight is wide), the time lag of scanning lines within the lighting range becomes so large as not to be negligible, so that even if optimum for some scanning line, the timing of lighting may not be said to be fit for other scanning lines. To solve this, there occurs the need for an increase in the number of backlights. Ideally, backlights equal in number to the scanning lines need only to be provided, but such an arrangement is difficult in actuality.

Thus, it is an object of the present invention to provide a novel method for improving the display characteristics of an image.

SUMMARY OF THE INVENTION

To solve the problems mentioned above, the present invention provides an image display method in a liquid crystal display equipped with a liquid crystal panel which comprises a plurality of gate lines, a plurality of data lines and pixel cells disposed in the shape of a matrix corresponding to their intersections, comprising: a step of selecting a gate line for the display of an image on the liquid crystal panel in a term during the period of displaying one image and moreover supplying an image signal to display the image to the above data line; and a step of again selecting the gate line in a term other than the one during the same period as that of the above-mentioned one term and moreover supplying a non-image signal having a predetermined voltage and different from the image signal to the data line.

Further, the present invention is further directed to a liquid crystal display comprising: a plurality of gate lines; first and second data line groups each comprising a plurality of data lines; a liquid crystal panel divided into a first pixel array and a second pixel array wherein the first pixel array comprises gate lines, data lines in the first data line group and pixel cells disposed in the shape of a matrix corresponding to their intersections and the second pixel array comprises gate lines, data lines in the second data line group and pixel cells disposed in the shape of a matrix corresponding to their intersections; gate line driver for selecting gate lines for each of the first and second pixel arrays; a first data line driver for supplying a signal to data line in the first data line group; a second data line driver for supplying a signal to data line in the second data line group; a controller for controlling the gate line driver so as to select a gate line for each of the first and second pixel arrays for the display of an image on the liquid crystal panel and controlling the first and second data line drivers so as to supply an image signal to display an image to the first and second data line groups in one term during the period of displaying one image and moreover for controlling the gate line driver so as to again select the gate line for each of the first and second pixel arrays and controlling the first and second data line drivers so as to supply a non-image signal having a predetermined voltage and different from the image signal to the first and second data line groups in a term other than the above-mentioned one during the same period as that of the above-mentioned one term.

Each gate line is usually selected only once during the period of displaying one image but selected twice or more in the above arrangement. One is a selection for the image display and the other are selections for the a non-image display (blanking). By selecting the gate line again independently of the image display and making a pixel cell into a condition corresponding to the non-image signal, blanking can be accomplished in the unit of a gate line.

BRIEF DESCRIPTION OF THE DRAWINGS

Preferred embodiments of the present invention will now be described, by way of example only, with reference to the accompanying drawings in which.

DETAILED DESCRIPTION OF THE PREFERRED EMBODIMENTS

Figure 1:
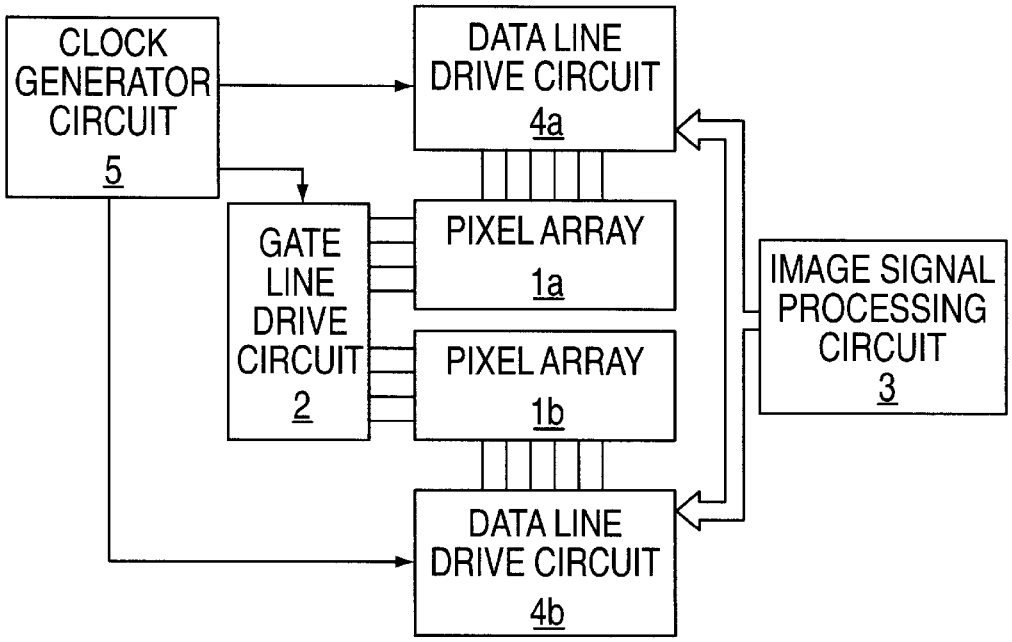
FIG. 1 is a block diagram of a liquid crystal display according to one embodiment of the present invention.
Figure 2:
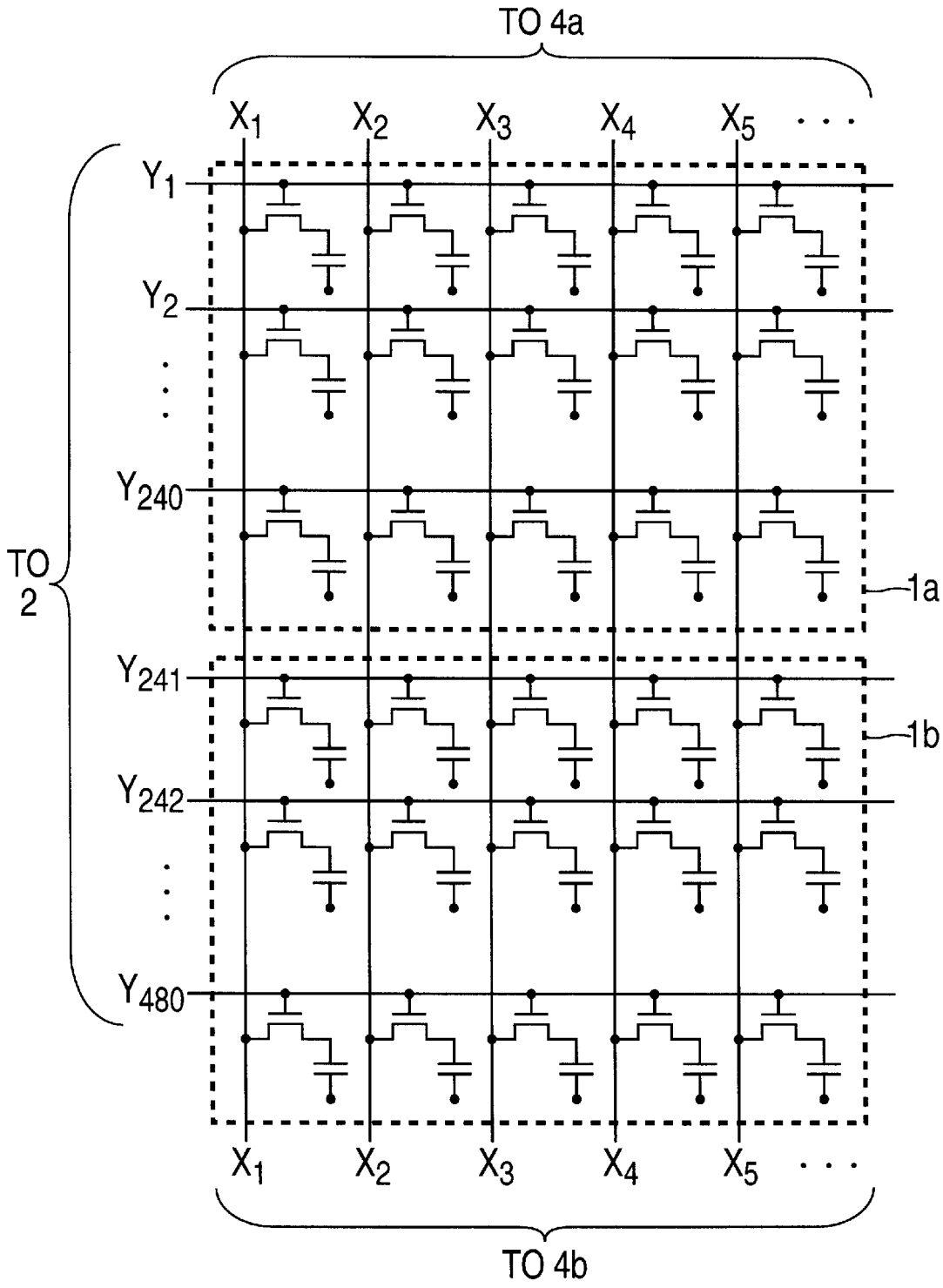
FIG. 2 is a configurational diagram of a pixel array.

FIG. 1 is a block diagram of a liquid crystal display according to one embodiment of the present invention. Here, a liquid crystal panel composed of 480 gate lines and 640 data lines will be taken as an example for the description. As the interface to a liquid crystal display, use will be made of a dual scan scheme employed in the STN mode. The display part of a liquid crystal panel is divided into two pixel arrays 1*a* and 1*b* at the center of the panel. As shown in FIG. 2, the pixel array 1*a* has 240 gate lines $Y_1$ to $Y_{240}$ and 640 data lines $X_1$ to $X_{640}$ constitutive of a first data line group, at intersections of which pixel cells are disposed in the shape of a matrix, while the pixel array 1*b* has the remaining 240 gate lines $Y_{241}$ to $Y_{480}$ and 640 data lines X constitutive of a second data line group, at intersections of which pixel cells are disposed in the shape of a matrix. Here, the first and second data line groups are provided respectively for writing data into pixel cells in the pixel array 1*a* and into those in the pixel array 1*b*, each of which is composed of 640 data lines.

The gate line drive circuit 2, provided for selecting desired gate lines Y out of 480 gate lines Y, is featured by selecting two gate lines at the same time. That is, it selects any one of gate lines $Y_1$ to $Y_{240}$ constitutive of the pixel array 1*a* and at the same time selects any one of gate lines $Y_{241}$ to $Y_{480}$ constitutive of the pixel array 1*b* as well.

The image signal processing circuit 3 is a circuit for converting the information item supplied from the outside into a signal displayable for a liquid crystal panel to supply it to the data line drive circuits 4*a* and 4*b*.

The data, line drive circuits 4*a* and 4*b* are provided for the respective pixel arrays 1*a* and 1*b*. In accordance with the display information item inputted from the image signal processing circuit 3, one data line drive circuit 4*a* supplies a signal which makes individual pixel cells connected to the gate line selected in the pixel array 1*a* into a desired condition. The other data line drive circuit 4*b* supplies a signal which makes individual pixel cells connected to the gate line selected in the pixel array 1*b* into a desired condition.

By supplying its generated control signals to the gate line drive circuit 2 and data line drive circuits 4*a* and 4*b*, the clock generator circuit 5 controls these circuits. To be specific, to display an image on a liquid crystal panel in one term during the period of displaying one image (e.g., 1 frame period (ordinarily 17 ms) in an ordinary case of displaying 60 frames of images for a second), a control signal is supplied to the gate line drive circuit 2 which selects one, gate line for each of the pixel arrays 1*a* and 1*b*. And, a control signal is supplied to the data line drive circuits 4*a* and 4*b* which supplies an image signal displaying an image to the first and second data line groups at the same time. Furthermore, in another term during the same one frame period, a control signal is supplied to the gate line drive circuit 2 which selects the respective gate line having once been selected. again for individual pixel arrays 1*a* and 1*b*. And, a control signal is supplied to the data line drive circuits 4*a* and 4*b* which supplies a non-image signal having a predetermined potential and different from the image signal to the first and second data line groups at the same time.

In this embodiment, a bent orientation cell (n cell) is employed as a pixel cell. Here, a bent orientation cell is expected as rapidly improving the dynamic image display characteristics with an eye to good response characteristics. Because of being well known itself, the bent orientation cell will not be further described, but the description of Japanese Patent Application No. 9-7132 is to be referred to if necessary.

As seen from the above-mentioned arrangement of a liquid crystal display, aside from charging operation into a pixel cell corresponding to an ordinary image signal in one frame period, another charging operation corresponding to a non-image signal is further performed in this embodiment. The non-image signal in this embodiment is a signal for displaying a blanking image. This blanking image is an image in which the whole screen may be a gray uniformity. From the viewpoint of bringing the contrast into focus, a black image is preferable.

That is, this embodiment is featured by writing a voltage of the black level once at an interval of ordinary rewrite for each frame.

Figure 3:
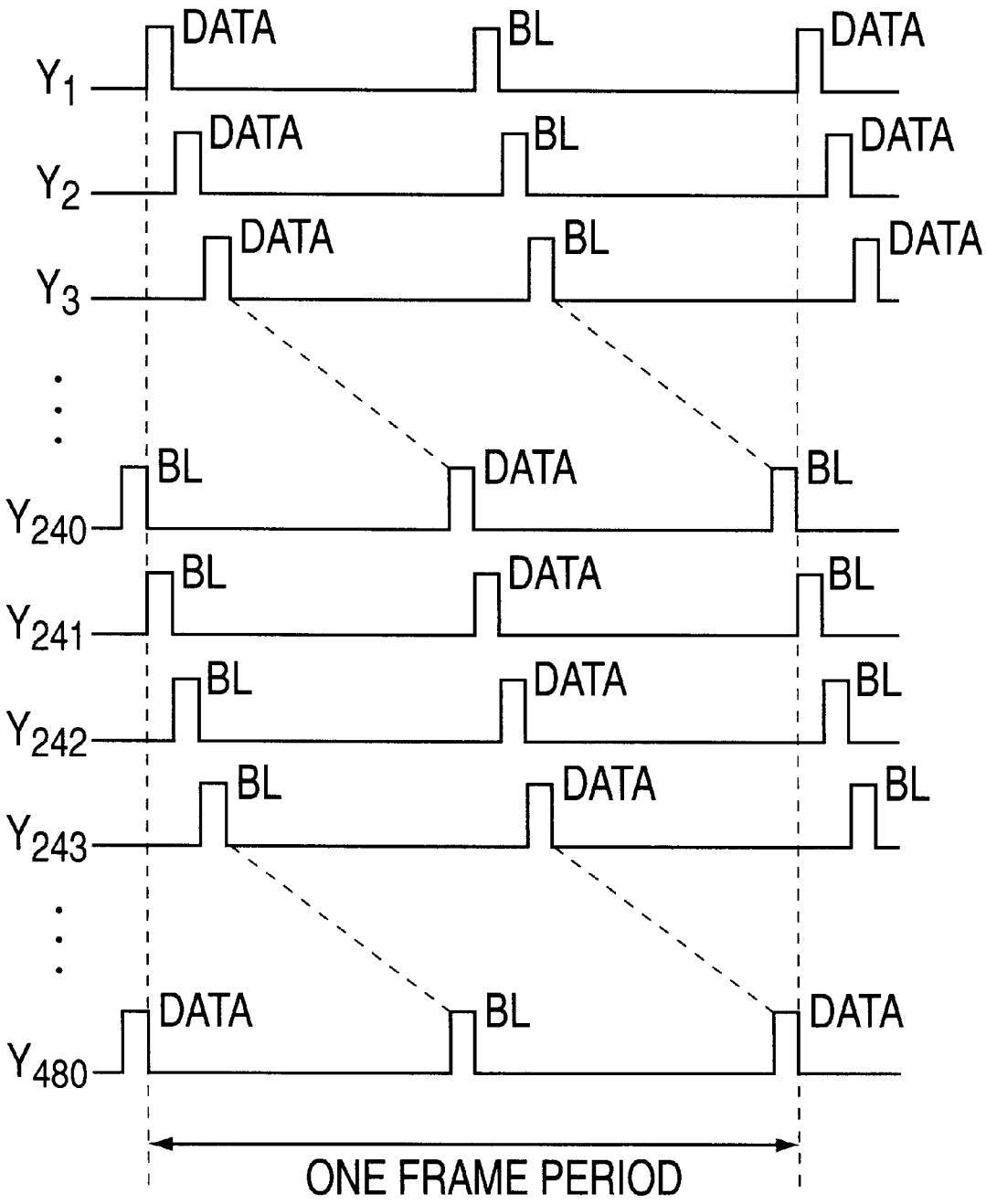
FIG. 3 is a timing chart regarding gate lines.

FIG. 3 is a timing chart related to gate lines. The gate lines $Y_1$, to $Y_{480}$ are successively activated to an on-state to write an image signal into pixel cells at slight time lags during one frame period. With the turning on of all 480 gate lines and the write of an image signal into pixel cells, one frame period ends. At this time, the gate lines $Y_1$ to $Y_{480}$ are turned on again after a delay of a half frame or a fraction of the term a frame period from the turning on for the write of an image signal to supply a black-displaying voltage to individual pixel cells via data lines X. Thereby, individual pixel cells become a black-displaying condition. That is, individual gate lines Y reach a high level twice at different terms in one frame period. At the first selection, pixel cells display image data for a definite time and forcibly display black at the subsequent second selection, thus achieving a blanking.

It originates in the need for two display operations during one frame period to divide a pixel array in the display panel into two and allow each pixel array to perform a display operation in such a manner. In the case of not dividing a pixel array, if the term of keeping the gate lines at a high level is made a half of that of a conventional scheme and the clock operation is allowed to proceed by a double number of clocks, the operation may be performed. However, even if the bent orientation cell is excellent in high-speed response, such a design would accompany considerable difficulties. Thus, by having a data line drive circuit provided for each divided pixel array and supplying data from above and below the liquid crystal panel, double the amount of gate write in a general single scan scheme becomes possible. Of course, the more writing operations can be performed during one frame period by dividing a pixel array into the more blocks to operate individual blocks.

Like this, with the state of individual gate lines made to a high level twice during one frame period, an image display and a black display are performed. Since blanking can be accomplished in the unit of a gate line, blanking can be made at the optimal timing for each gate line. Accordingly, in contrast to a conventional method for successively bringing a plurality of backlights into intermittent lighting at a predetermined timing, the blur of a dynamic image can be effectively reduced, thereby enabling the quality of a display image to be enhanced.

Further, this embodiment can solve the pre-condition dependence which is an inherent problem in the high-speed response mode of liquid crystal, because the condition preceding to activating the gate line to on-state for displaying image is always a definite condition in which black is displayed. This point will be described in detail. In a high-speed response liquid crystal mode such as bent orientation cells (π cell), the blur of a display image at the time of continuous lighting is smaller than in the TN mode. It was revealed from the experiments by the inventors that as with the background art, using a plurality of pulsatory backlights in the high-speed response mode could solve this blur, but could not eliminate a ghost. Even if the number of backlights is increased and the time of lighting is shortened, only one ghost remains.

Figure 4:
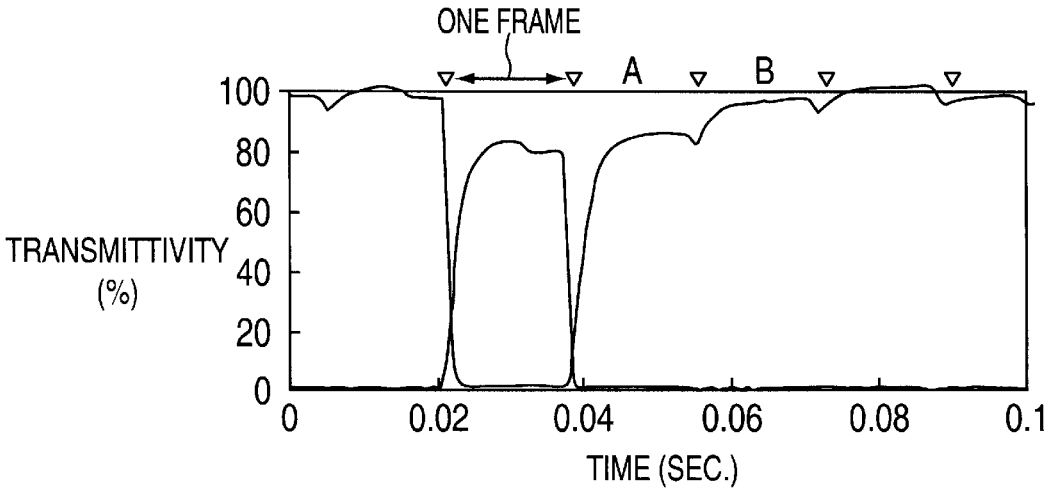
FIG. 4 is a graph showing a time change in the transmittivity of a bent orientation cell.

To examine this problem, a time change in the transmittivity of a bent orientation cell was observed. FIG. 4 is a graph showing a time change in the transmittivity of a bent orientation cell. In the first frame A having changed from the black level to the white level, the target white level is not completely attained and this frame stays at a midway gray level and further in the second frame B for writing a white level, the white level is at last attained. The cause for this is attributable to a change in the electric capacity of liquid crystal cells. That is, the amount of electric charge retained in cells by the write is an amount charged at a write voltage (V1) in a cell capacity (letting V0: a voltage prior to the write, represented by Ca (VO)) which is determined by the molecular orientation of liquid crystal prior to the write. And, after the write, the molecular orientation of liquid crystal becomes a different equilibrium state and the cell voltage (Ve) at that time is at such level that the product of the cell voltage (Ve) and the cell electric capacity (represented by Ca(Ve)) in this equilibrium equal to the amount of electric charge in the previous equilibrium.

$$Ve \cdot Ca(Ve) = V1 \cdot Ca(V0)$$

Thus, the inventors became aware that the cell voltage (Ve) in the post-write equilibrium state is generally unequal to the write voltage (V1) and depends on the cell voltage (V0) just before the write. This is to be called a pre-state dependence. It is a phenomenon which cannot be confirmed in a slow liquid crystal mode such as TN mode.

It turned out that from these reasons, in the case of using an intermittent lighting system of backlights in the high-speed response liquid crystal mode, the blur of dynamic images was dissolved but on account of the pre-state dependence peculiar to the high-speed response liquid crystal mode, a ghost occurred and the dynamic image display characteristics of the same level as with the CRT could not be obtained. As regard such a problem, by once writing a constant gray level of voltage between the ordinary rewrite for individual frames, it becomes possible to eliminate the pre-state dependence. In this embodiment, since the state before the display of an image never fails to be a definite state of black display, a ghost due to the pre-state dependence as mentioned above can be effectively reduced. Additionally, instead of supplying black level in advance, it can be applied to correct the voltage to charge the cell itself in consideration of the change of voltage based on the pre-state dependence, so that this pre-state dependence may be eliminated.

Experiments by the inventors revealed that the occupied ratio of the display period of pixel cells during one frame period ranges preferably from 20% to 75% in the respect of image quality and the optimum image is obtained especially in the range of 30% to 60%.

Incidentally, in the above embodiment, a liquid crystal panel using the bent orientation cell (π cell) was described as an example of the high-speed response liquid crystal mode, but other examples using a liquid crystal mode such as ferroelectric liquid crystal panel or antiferroelectric liquid crystal panel may be employed. At present, since the usually employed TN mode is slow in dynamic image response characteristics, writing twice during one frame period is not always fit. In a high-speed response liquid crystal mode, however, since the standup time from the minimum voltage to the maximum voltage is less than 1 ms for a bent orientation cell and very high, in speed as about 2–5 ms for its contrary, the above operation has also a sufficient follow-up property. A liquid crystal panel using such a liquid crystal mode has a high-speed property not inferior to that of a CRT and can implement an LCD having dynamic image display characteristics similar to those of a CRT. In fact, it was confirmed that the blur of an image is fairly reduced as compared with the TN mode.

Besides, this embodiment was described as one example of supplying, a predetermined voltage which brings about a black display as a non-image signal. However, the scope of the present invention includes any voltage which displays other colors than black. Furthermore, here, the predetermined voltage having a non-image signal means a substantial constant voltage. Namely, it is also included in the present invention that the gray is somewhat varied in such an adaptable manner as not to cause a visual influence so much in conformity with the condition of an image.

By combining this embodiment with the intermittent lighting system of backlights, a further improvement in the quality of a display image is expected.

Like this, according to the present invention, all individual gate lines are selected over again for the blanking except the selection for the display of an image. And, a series of such operations as multiple selection of gate lines and corresponding supply of signals to data lines are carried out during the term of displaying one image (one frame period). Thus, since the execution of blanking at the optimum timing for each gate line becomes possible, it is made possible especially in a dynamic image display to obtain a good image quality in which the blur of an image is reduced and no ghost appears.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

Having thus described our invention, what we claim as new, and desire to secure by Letters Patent is:

1. A method of displaying an image on a liquid crystal display equipped with a crystal panel which comprises a plurality of gate lines, a plurality of data lines, and pixel cells disposed in the shape of a matrix corresponding to the intersections of said gate lines and said data lines, comprising the steps of:

(a) selecting said gate line for the display of an image on said liquid crystal panel in a first term during a frame period for displaying one image and moreover supplying an image signal to display said image to said data line; and (b) selecting said gate line again in a second term during the same frame period as that of said first term, said first term and said second term being in the same frame period, and supplying a non-image signal having a predetermined potential and different from said image signal to said data line during said second term, whereby supply of said non-image signal is for displaying a blanking image.

2. The method as set forth in claim 1, wherein said non-image signal is a signal for displaying a blanking image on said liquid crystal panel.

3. The method as set forth in claim 1, wherein said blanking image is a black image.

4. The method as set forth in claim 1, wherein said liquid crystal panel is a liquid crystal panel using a bent orientation cell, a ferroelectric liquid crystal panel or antiferroelectric liquid crystal panel.

5. The method as set forth in claim 1, wherein the occupying ratio of the display period of said pixel cell during said one frame period is within the range of 20% to 75%.

6. The method as set forth in claim 1, wherein the occupying ratio of the display period of said pixel cell during said one frame period is within the range of 30% to 60%.

7. The method as set forth in claim 1, wherein the period for displaying said one image is one frame period.

8. The method as set forth in claim 7, wherein said one term is shifted from said another term by ½ frame period.

9. A liquid crystal display comprising:

a plurality of gate lines;

first and second data line groups each comprising a plurality of data lines;

a liquid crystal panel divided into a first pixel array and a second pixel array wherein said first pixel array comprises said gate lines, said data lines in said first data line group and pixel cells disposed in the shape of a matrix corresponding to the intersections of said gate lines and said data lines and said second pixel array comprises said gate lines, said data lines in said second data line group and pixel cells disposed in the shape of a matrix corresponding to the intersections of said gate lines and said data lines;

gate line driver for selecting said gate line for each of said first and said second pixel arrays;

a first data line driver for supplying a signal to said data line in said first data line group;

a second data line driver for supplying a signal to said data line in said second data line group;

a controller for controlling said gate line driver so as to select said gate line for each of said first and second pixel arrays in order to display an image on said liquid crystal panel in a first term during a frame period for displaying one image and controlling said first and second data line drivers so as to supply an image signal for displaying said image to said first and second data line groups and moreover for controlling said gate line driver so as to again select said gate line for each of said first and second data pixel arrays and controlling said first and second data line drivers so as to supply a non-image signal having a predetermined voltage and different from said image signal to the first and second data line groups in a second term, said first term and said second term being in the same frame period, whereby supply of said non-image signal is for displaying a blanking image.

10. A liquid crystal display as setforth in claim 9, wherein said non-image signal is a signal for displaying a blanking image on said liquid crystal panel.

11. A liquid crystal display as set forth in claim 9, wherein said blanking image is a black image.

12. A liquid crystal display as set forth in claim 9, wherein said liquid crystal panel is a liquid crystal panel using a bent orientation cell, a ferroelectric liquid crystal panel or antiferroelectric liquid crystal panel.

13. A liquid crystal display as set forth in claim 9, wherein the occupying ratio of the displaying period of said pixel cell during said one frame period is within the range of 20% to 75%.

14. A liquid crystal display as set forth in claim 9, wherein the occupying ratio of the display period of said pixel cell during said one frame period is within the range of 30% to 60%.

15. The liquid crystal display as set forth in claim 9, wherein the period for displaying said one image is one frame period.

16. The liquid crystal display as set forth in claim 15, wherein said one term is shifted from said another term by ½ frame period.

* * * * *